US009382095B2

(12) United States Patent
Rusanen et al.

(10) Patent No.: US 9,382,095 B2
(45) Date of Patent: Jul. 5, 2016

(54) ELEVATOR SYSTEM FOR GENERATING AUTOMATIC ELEVATOR CALLS USING A PERSONAL IDENTIFIER

(71) Applicants: Niko Rusanen, Helsinki (FI); Rauno Hatakka, Riihimaki (FI)

(72) Inventors: Niko Rusanen, Helsinki (FI); Rauno Hatakka, Riihimaki (FI)

(73) Assignee: Kone Corporation, Helsinki (FI)

( * ) Notice: Subject to any disclaimer, the term of this patent is extended or adjusted under 35 U.S.C. 154(b) by 545 days.

(21) Appl. No.: 13/875,801

(22) Filed: May 2, 2013

(65) Prior Publication Data

US 2013/0248300 A1 Sep. 26, 2013

Related U.S. Application Data

(63) Continuation of application No. PCT/FI2011/050955, filed on Oct. 31, 2011.

(30) Foreign Application Priority Data

Nov. 3, 2010 (FI) ..... 20106153

(51) Int. Cl.
*B66B 1/18* (2006.01)
*B66B 1/46* (2006.01)

(52) U.S. Cl.
CPC ..... *B66B 1/468* (2013.01); *B66B 2201/4615* (2013.01); *B66B 2201/4638* (2013.01); *B66B 2201/4676* (2013.01)

(58) Field of Classification Search
CPC ..... B66B 1/468; B66B 2201/4615; B66B 2201/4638; B66B 2201/4676
USPC ..... 187/247, 380–388, 391, 392, 393
See application file for complete search history.

(56) References Cited

U.S. PATENT DOCUMENTS

| | | | | |
|---|---|---|---|---|
| 5,689,094 | A | 11/1997 | Friedli et al. | |
| 5,949,037 | A | 9/1999 | Oya | |
| 5,952,626 | A * | 9/1999 | Zaharia | B66B 1/468 187/381 |
| 6,109,396 | A * | 8/2000 | Sirag | B66B 1/468 187/381 |
| 6,202,799 | B1 * | 3/2001 | Drop | B66B 1/468 187/384 |
| 6,209,685 | B1 * | 4/2001 | Zaharia | B66B 1/468 187/381 |
| 6,223,160 | B1 | 4/2001 | Kostka et al. | |
| 6,394,232 | B1 * | 5/2002 | Iwata | B66B 1/2458 187/247 |
| 7,377,364 | B2 * | 5/2008 | Tyni | B66B 1/468 187/380 |

(Continued)

FOREIGN PATENT DOCUMENTS

| | | |
|---|---|---|
| JP | 11-79572 | 3/1999 |
| JP | 2008050066 A | 3/2008 |

(Continued)

OTHER PUBLICATIONS

Finnish Search Report dated Mar. 22, 2011.

(Continued)

*Primary Examiner* — Anthony Salata
(74) *Attorney, Agent, or Firm* — Harness, Dickey & Pierce, P.L.C.

(57) ABSTRACT

A method includes generating automatic elevator calls in an elevator system using a personal identifier, reading identification data of an identifier on a first departure floor, connecting information about the departure floor to the identification data, reading the identification data on some second departure floor, and on the basis of the identification data, generating an elevator call for taking the passenger back to the first departure floor.

11 Claims, 1 Drawing Sheet

(56) References Cited

U.S. PATENT DOCUMENTS

| | | | | |
|---|---|---|---|---|
| 7,500,544 | B2 * | 3/2009 | Hakala | B66B 1/463 187/382 |
| 8,047,334 | B2 * | 11/2011 | Christy | B66B 1/2458 187/384 |
| 8,151,943 | B2 * | 4/2012 | de Groot | B66B 1/2458 187/382 |
| 8,210,321 | B2 * | 7/2012 | Finschi | B66B 1/14 187/388 |
| 2007/0151809 | A1 | 7/2007 | Tyni et al. | |
| 2007/0272495 | A1 | 11/2007 | Makela et al. | |
| 2015/0251874 | A1 * | 9/2015 | Salmikuukka | B66B 1/468 187/380 |

FOREIGN PATENT DOCUMENTS

| | | | |
|---|---|---|---|
| WO | WO-2006000618 | A2 | 1/2006 |
| WO | WO-2006070051 | A2 | 7/2006 |

OTHER PUBLICATIONS

Written Opinion PCT/ISA/237 for International Application No. PCT/FI2011/050955.

International Search Report PCT/ISA/210 for International Application No. PCT/FI2011/050955.

* cited by examiner

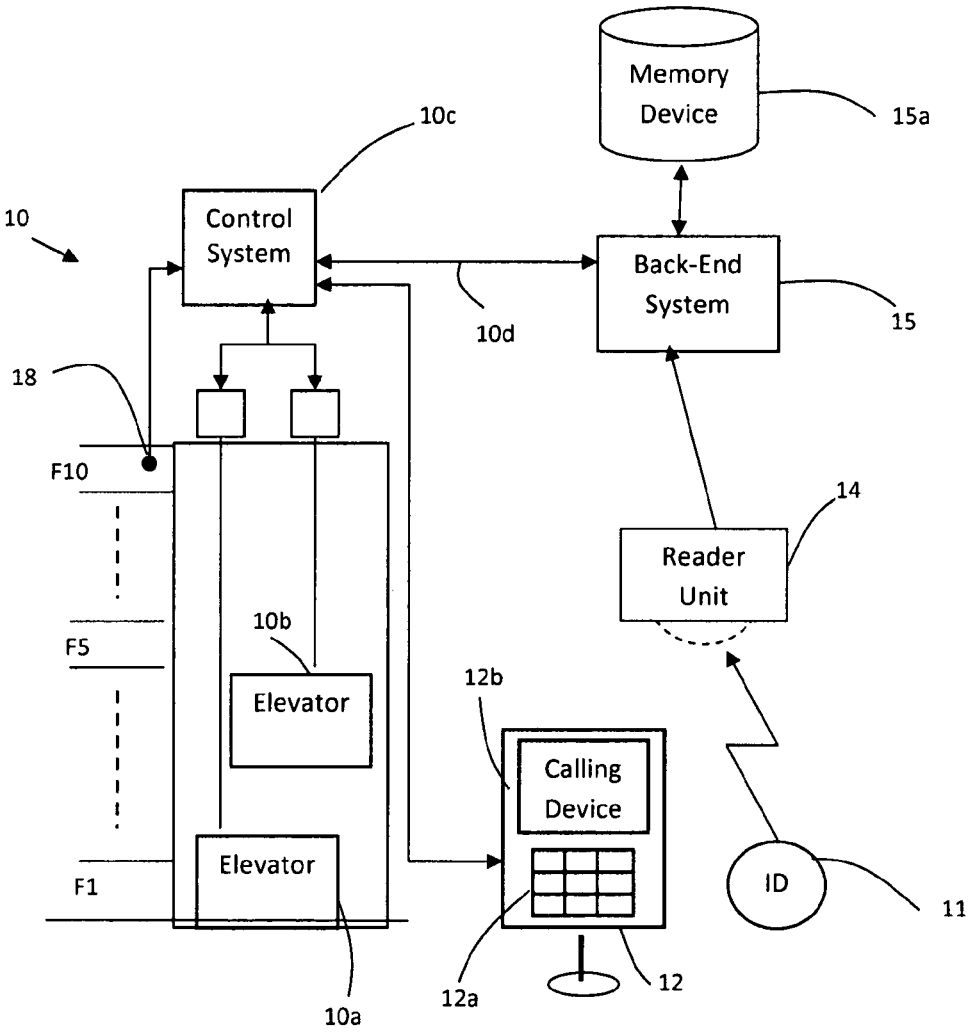
Memory Device
15a
10c
10
Control System
Back-End System
15
10d
18
F10
14
Reader Unit
10b
F5
Elevator
12b
Calling Device
Elevator
F1
ID
11
12
12a
10a

ELEVATOR SYSTEM FOR GENERATING AUTOMATIC ELEVATOR CALLS USING A PERSONAL IDENTIFIER

This application is a continuation of PCT International Application No. PCT/FI2011/050955 which has an International filing date of Dec. 31, 2011, which claims priority to Finnish patent application number FISN 20106153 filed Nov. 3, 2010; the entire contents of each of which are hereby encorporated by reference.

FIELD OF THE INVENTION

The invention relates to elevator systems. More particularly the invention relates to a method and to an elevator system for generating automatic elevator calls using a personal identifier.

BACKGROUND OF THE INVENTION

With regard to elevator systems, call-giving solutions are known in which a passenger can give a destination call to the elevator system by means of an identifier, e.g. by means of an RFID identifier (Radio Frequency Identifier) in his/her possession. The elevator system must in this case be provided with reader units, which read the data contained in the identifier (so-called identification data) and transmit it to the elevator system. On the basis of the identification data the elevator system determines the destination floor specific to a passenger and allocates from the elevator system an elevator car for traveling to the floor in question. The destination floor is typically the floor to which a passenger repeatedly travels, e.g. the floor on which his/her work point is situated. Often access control is also connected to said prior-art solutions such that for each passenger, information about those destination floors in the building, and about other spaces belonging to the access control area and to which the passenger has an access right, is saved in the elevator system or in a special access control system.

A number of drawbacks are, however, connected to the prior-art call-giving solutions described above. The personal information to be connected to the identifier of a passenger, such as said destination floors to be connected to automatic calls, must be manually configured into the elevator system or into an access control system in connection with the elevator system. Configuration is generally performed by the system administrator, which increases the maintenance costs of the system and in general hampers the flexible use of identifiers for giving elevator calls. Prior-art solutions are also poorly applicable to cases in which a passenger must regularly use a number of different elevator systems, which can even be in different buildings.

AIM OF THE INVENTION

The aim of the present invention is to eliminate or at least to alleviate said drawbacks that occur in prior-art solutions. The aim of the invention is also to achieve one or more of the following objectives:

- a self-learning system, which automatically registers and repeats the elevator journeys made by passengers,
- to facilitate and speed up travel in elevator systems,
- a simple and cost-effective elevator system for generating automatic elevator calls,
- a call-giving solution, which is suited for use in a number of elevator systems that are separate from each other.

SUMMARY OF THE INVENTION

The method according to the invention is characterized by what is presented in the characterization part of claim 1. The elevator system according to the invention is characterized by what is presented in the characterization part of claim 7. Other embodiments of the invention are characterized by what is presented in the other claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the scope of the basic inventive concept in conjunction with other embodiments.

The present invention discloses a method for generating automatic elevator calls in an elevator system by means of personal identifiers given into the possession of passengers. In the method the identification data contained in an identifier is read on the first departure floor of a passenger, information about said first departure floor is connected to the identification data, the identification data is read on some second departure floor to which the passenger has transferred from the first departure floor, and an automatic elevator call for taking the passenger from said second departure floor to said first departure floor is generated. The term departure floor refers in this context to the floor on which the identifier of a passenger is read and from which he/she can travel with the elevator to the destination floor that he/she wants. The term elevator call refers to any call whatsoever given to an elevator system. The identifier given into the possession of a passenger is e.g. a remotely-readable RFID identifier or some other personal identifier suited to the purpose. For reading the identification data contained in an identifier, the elevator lobbies and/or the elevator cars and/or the call-giving devices (call panels) of the elevator system are provided with suitable reader units.

The basic concept of the invention is that an elevator system, or a system in connection with it, saves the departure floor of a passenger before each elevator journey and automatically generates an elevator call for taking the passenger from the current floor to the departure floor of the previous elevator journey. In the method according to the invention a passenger gives at the beginning of a first elevator journey a manual elevator call to the destination floor he/she wants and when he/she leaves from the destination floor in question and comes to the elevator lobby of a floor, the elevator system automatically generates an elevator call for taking the passenger from the floor in question to the departure floor of the previous elevator journey. The elevator system is therefore a self-learning system and does not need configuration of the data for the destination floors of a passenger, or other corresponding data, by the administrator of the elevator system. As a result of this self-learning capacity, a passenger can without difficulty use the same personal identifier in a number of different buildings having elevator systems in which the solution according to the invention is applied.

In one embodiment of the invention the classification data given by a passenger in connection with a manual elevator call is registered, which classification data is connected to automatic elevator calls to be generated later for the passenger. The classification data indicates that a passenger belongs to some special group, e.g. that he/she is physically handicapped. As a result of the embodiment, the elevator system automatically learns and takes into account the special needs of a passenger in the elevator service.

In one embodiment of the invention the elevator journeys made by a passenger during a visit are saved, on the basis of which elevator journeys automatic elevator calls are generated during the following visit. As a result of the embodiment, a passenger can easily save e.g. the elevator journeys made during his/her workdays and repeat the same elevator journeys automatically when going to the building on the following workday.

In one embodiment of the invention the elevator system is provided with at least one movement detector, with which the arrival of passengers in an elevator lobby (at the departure floor) is detected. On the basis of the identification signal of the movement detector, an automatic landing call is generated for getting an elevator car to the floor in question. After the passenger has transferred from the elevator lobby into the elevator car serving him/her, the reader unit in the elevator car reads the identification data contained in the identifier of the passenger, on the basis of which identification data an automatic elevator call to the departure floor of the previous elevator journey can be generated.

The present invention also discloses an elevator system for generating automatic elevator calls. The elevator system comprises at least one elevator, a control system controlling the elevator system, and also call-giving devices for registering manual elevator calls. The elevator system further comprises a back-end system in connection with said control system, and also at least one reader unit for reading the identification data contained in the identifiers given into the possession of passengers. The elevator system is arranged to read the identification data contained in an identifier of a passenger on the first departure floor of the passenger, to connect the information about said first departure floor to said identification data, to read the identification data of the identifier on the second departure floor of the passenger, and to generate an automatic elevator call for taking the passenger from the second departure floor to the first departure floor on the basis of said identification data.

With the solution according to the invention numerous advantages are achieved compared to prior-art solutions. The elevator system according to the invention is a self-learning system and does not require personnel resources for configuring or updating passenger-specific data, in which case the elevator system becomes simple and maintenance work is minimized. The teaching of elevator journeys is based on predicting elevator journeys made by the passenger himself/herself, making the system easy to use and flexibly applicable for use even in elevator systems located different buildings. In this context, reference is also made to the other advantages to be achieved with the invention, which are presented above in connection with the different embodiments.

LIST OF FIGURES

In the following, the invention will be described in detail by the aid of examples of its embodiments, wherein:

FIG. 1 presents one elevator system according to the invention.

DETAILED DESCRIPTION OF THE INVENTION

FIG. 1 presents one elevator system 10 according to the invention, which comprises the elevators 10*a* and 10*b* of the elevator system 10, a control system 10*c* of the elevator system, a back-end system 15 connected to the control system 10*c*, and also call-giving devices 12 in the elevator lobbies and/or in the elevator cars for registering manual elevator calls. An identifier 11 is given for the personal use of a passenger, which identifier is e.g. a remotely-readable RFID identifier and the identification data contained by which identifier can be read by reader units 14 in the elevator lobbies (in FIG. 1 only the reader unit of the entrance lobby floor F1 is presented). The identification data contain e.g. the individual ID number of the identifier, which ID number the reader unit 14 reads and transmits to the back-end system 15. Alternatively, the reader units can be disposed in the elevator cars, instead of in the elevator lobbies, in which case either a passenger must give a manual elevator call in the elevator lobby, or the elevator lobbies must be provided with optical or other corresponding movement detectors for calling an elevator car to the floor level when a passenger arrives in an elevator lobby to wait for an elevator. In FIG. 1 a movement detector on the topmost floor F10 is presented with the reference number 18 by way of example, which movement detector detects passengers arriving in the elevator lobby of floor F10 and sends the detection data to the control system 10*c* for ordering an elevator car to the floor F10. After an elevator car has arrived at the floor F10 and the passenger moves into the elevator car, the reader unit in the elevator car reads the ID number of the identifier of the passenger, on the basis of which ID number the elevator system generates an automatic destination call if the passenger does not give a manual destination call with the call pushbuttons in the elevator car.

Destination call panels and/or conventional up/down pushbuttons in the elevator lobbies can be used as call-giving devices 12. FIG. 1 presents only the destination call panel 12 disposed on the floor F1 (the entrance lobby floor), which destination call panel comprises call pushbuttons 12*a* for registering a manual destination floor call, as well as a display unit 12*b* for indicating the elevator serving the call to the passenger who gave the call. In addition to call pushbuttons 12*a*, a destination call panel comprises a classification pushbutton 12*aa*, with which a physically handicapped passenger can order handicapped-accessible transport for himself/herself. Elevators serving automatic elevator calls can also be indicated with a display unit 12*b* and/or the elevator lobbies can be provided with signs (not presented in FIG. 1) for indicating the serving elevators. It is also possible to provide identifiers 11 with a display unit, to which the elevator system transmits information about the elevator serving a passenger.

The back-end system 15 comprises a processing unit, software and also a memory means 15*a* for saving information connected to automatic elevator calls. The back-end system is connected via a data transfer connection 10*d* to the control system 10*c* for sending automatic elevator calls from the back-end system to the control system and also, if necessary, for transmitting the status information of the elevators from the control system to the back-end system.

When the holder of an identifier 11 (a passenger) arrives in the entrance lobby F1 of a building for the first time, he/she goes to a call-giving device 12 and gives a manual destination call e.g. to floor F5. In the same connection, the reader unit 14 in the entrance lobby reads the ID number of the identifier and transmits it to the back-end system 15. The back-end system 15 receives the ID number, opens in the memory means 15*a* the data record corresponding to the ID number and saves in the data record information about the departure floor of the passenger, which in this example case is the entrance lobby F1. The control system 10*c* allocates to the passenger an elevator car, which takes him/her from the entrance lobby floor F1 to the floor F5. After arriving at floor F5 the passenger moves e.g. into his/her office. When the passenger returns back to the elevator lobby of floor F5, the reader unit 14 in the elevator lobby of floor F5 detects the identifier 11 of the passenger, reads the ID number contained in said identifier and transmits the ID number to the back-end system 15. The back-end system, on the basis of ID number, identifies the data record, which comprises information about the departure floor of the previous elevator journey of the passenger and generates an automatic destination call from floor F5 to the departure floor in question, which in this example case is the entrance lobby floor F1. In the same connection, the back-end system updates the new departure floor (floor F5) in the data record for the following elevator journey. When the passenger e.g. on the following morning arrives in the entrance lobby F1 of the building, the back-end system generates in the manner described above an automatic destination call from the entrance lobby floor F1 to the floor F5. If a passenger has, in connection with a manual call, pressed the classification pushbutton 12*aa*, this is taken into account also when generating automatic calls by ordering for the passenger elevator transport according to the classification, e.g. by lengthening the door times of the doors of the elevator for a physically handicapped passenger.

In the preceding example, the elevator lobbies contain reader units 14, which read the identification data contained in the identifiers 11 of passengers in the elevator lobbies. Since the back-end system 15 has the position data of the reader units available for its use, the back-end system can detect the elevator lobby of which floor at which a passenger arrives at any given time (by elevator or by walking) or from the elevator lobby of which floor a passenger leaves (by elevator or by walking). By means of the reader units the departure floor, on which floor the passenger moves into the elevator car, as well as the destination floor, where he/she leaves the elevator car, of an elevator journey performed by a passenger can thus be determined. A corresponding determination can be performed with the reader units in the elevator cars by detecting with a reader unit the presence of the identifiers of passengers in the elevator car and by identifying the floor at which the elevator car is located at the time of the detection.

According to one embodiment of the invention the back-end system 15 registers the elevator journeys made by a passenger during one visit. The term visit refers to the period of time from the moment a passenger arrives in a building to the moment he/she leaves the building. The embodiment comprises a type of "recording function", wherein the elevator journeys made by a passenger during one visit are saved in the memory means 15*a*, in the sequence in which they are performed, including information about the departure floor and destination floor of each elevator journey. In the example according to FIG. 1, the "recording function" starts when a passenger arrives at the entrance lobby floor F1 and the reader unit 14 on the entrance lobby floor F1 detects the identifier 11 of the passenger. The "recording function" ends in the example case according to FIG. 1 when the reader unit 14 on the entrance lobby floor F1 detects a passenger (identifier 11) leaving the detection area of the reader unit 14 in the entrance lobby F1 and the identifier 11 of the passenger is not detected after this with any reader unit 14 during a preset period of time. When the passenger visits the building on a following occasion and his/her identifier 11 is detected in the elevator lobbies of different floors, the back-end system generates automatic elevator calls on the basis of the elevator journeys saved in the memory means 15*a* taking into account the sequence of saving the elevator journeys for specific floors. If the passenger does not make an elevator journey according to said automatic elevator call (e.g. he/she does not step into the elevator car allocated to him/her), the back-end system deletes the elevator journey in question from the plurality of saved elevator journeys. Correspondingly, if a passenger gives a manual elevator call and makes an elevator journey, of which a "recording" has not been made, the back-end system adds the elevator journey in question to the plurality of saved elevator journeys.

The invention is not only limited to be applied to the embodiments described above, but instead many variations are possible within the scope of the inventive concept defined by the claims. Thus, for example, the back-end system presented in FIG. 1 as a separate computer system can be either fully or partly integrated into the control system 10*c*. Also the memory means 15*a*, as an exception to FIG. 1, can be integrated either fully or partly into the control system 10*c* and/or into the identifiers 11, and the reader units 14 can be used e.g. for sending data to be saved in the integrated memory means 15*a* to the identifiers 11.

The invention claimed is:

1. A method for generating automatic elevator calls in an elevator system using an identifier associated with a passenger, the method comprising:

first reading, from the identifier, identification data identifying the passenger when the passenger manually calls an elevator from a first floor;

linking origin information associating the identification data with the first floor, the origin information identifying an origin floor of the passenger;

storing the origin information in a back-end of the elevator system before a first elevator journey from the first floor;

second reading, from the identifier, the identification data when the passenger approaches the elevator on a second floor;

determining, from the origin information, a return floor associated with the passenger based on the identification data read when the passenger approaches the elevator on the second floor, the return floor being the origin floor; and generating an automatic elevator call associated with a second elevator journey to the first floor based on the return floor such that the automatic elevator call is generated without the passenger calling the elevator to initiate the second elevator journey.

2. The method according to claim 1, wherein the method further comprises:

registering classification data given by the passenger when the passenger calls the elevator, the classification data indicating that the passenger is associated with a special group; and generating the automatic elevator call based on the classification data.

3. The method according to claim 1, wherein the method comprises:

saving the first elevator journey and the second elevator journey made by the passenger during a visit as saved elevator journeys; and generating during a following visit one or more automatic elevator calls based on the saved elevator journeys.

4. The method to claim 1, wherein the first reading of the identification data and the second reading of the identification data are performed when the passenger is in an elevator lobby of a respective floor.

5. The method according to claim 1, wherein the first reading of the identification data and the second reading of the identification data are performed when the passenger is in an elevator car associated with the elevator.

6. The method according to claim 1, wherein the method further comprises:

detecting, via a movement detector installed in an elevator lobby of the second floor, an arrival of the passenger at the elevator lobby of the second floor, wherein the second reading is performed in response to the detecting the arrival of the passenger at the second floor.

7. An elevator system for generating automatic elevator calls, comprising:

at least one elevator accessible from at least a first floor and a second floor;

call-giving devices configured to register manual elevator calls;

a back-end system configured to store origin information therein, the origin information identifying an origin floor of a passenger;

at least one reader unit configured to connect to the back-end system to read one or more of identification data identifying the passenger and the origin information when the passenger approaches the at least one elevator; and a controller configured to, first read, from an identifier associated with the passenger, the identification data when the passenger manually calls the at least one elevator from the first floor, link the origin information with the first floor, store the origin information in the back-end system before a first elevator journey from the first floor, second read, from the identifier, the identification data when the passenger approaches the at least one elevator on the second floor, determine, from the origin information, a return floor associated with the passenger based on the identification data read when the passenger approaches the elevator on the second floor, the return floor being the origin floor, and generate an automatic elevator call associated with a second elevator journey to the first floor based on the return floor such that the automatic elevator call is generated without the passenger calling the at least one elevator to initiate the second elevator journey.

8. The elevator system according to claim 7, wherein the call-giving devices include at least one classification pushbutton configured to register classification data when the passenger calls the at least one elevator, the classification data indicating that the passenger is associated with a special group, and the back-end system is configured to, link the classification data to the identification data, and generate the automatic elevator call based on the classification data.

9. The elevator system according to claim 7, wherein the at least one reader unit is in an elevator lobby of a respective floor and/or an elevator car associated with the at least one elevator.

10. The elevator system according to claim 7, wherein the elevator system is: configured to, save the first elevator journey and the second elevator journey made by the passenger during a visit as saved elevator journeys, and generate during a following visit one or more automatic elevator calls based on the saved elevator journeys.

11. The elevator system according to claim 7, wherein the elevator system further comprises:

a movement detector in at least an elevator lobby of the second floor, the movement detector configured to instruct the back-end system to generate the automatic elevator call after the passenger has arrived at the elevator lobby of the second floor.

* * * * *